US008763191B1

(12) United States Patent
Milligan

(10) Patent No.: US 8,763,191 B1
(45) Date of Patent: Jul. 1, 2014

(54) LIQUID APPLICATION DEVICE

(76) Inventor: Loren Milligan, Baxter, IA (US)

( * ) Notice: Subject to any disclaimer, the term of this patent is extended or adjusted under 35 U.S.C. 154(b) by 836 days.

(21) Appl. No.: 12/179,489

(22) Filed: Jul. 24, 2008

(51) Int. Cl.
*A47L 23/02* (2006.01)

(52) U.S. Cl.
USPC ..... 15/104.92; 15/110; 15/160

(58) Field of Classification Search
USPC ..... 15/104.92, 104.93, 104.94, 110, 160, 15/DIG. 5
See application file for complete search history.

(56) References Cited

U.S. PATENT DOCUMENTS 2,953,805 A * 9/1960 Sevenich ..... 15/310
5,164,164 A * 11/1992 Strickler et al. ..... 422/292
5,724,695 A * 3/1998 Galizia ..... 15/160
6,146,588 A * 11/2000 Deighton ..... 422/28
6,309,126 B1 * 10/2001 Narula et al. ..... 401/202
6,662,398 B1 * 12/2003 Thomson ..... 15/104.92
6,684,444 B2 * 2/2004 Wheeler et al. ..... 15/110
2004/0237235 A1 * 12/2004 Visioli et al. ..... 15/104.94
2009/0113646 A1 * 5/2009 Rossell ..... 15/105

* cited by examiner

*Primary Examiner* — Robert Scruggs
(74) *Attorney, Agent, or Firm* — Schmeiser, Olsen & Watts LLP

(57) ABSTRACT

A liquid application device, for applying liquid to a user's foot, configured according to the present invention includes a base, further comprising a top and a bottom surface; a well formed in the top surface of the base, wherein the well is shaped in the approximation of a foot print and wherein the well has a peripheral wall; a non-slip surface coupled to the bottom surface of the base; an applicator removably coupled to the well wherein the applicator is formed in the approximate shape of a foot print and wherein the applicator is formed from a porous material; and wherein the applicator will hold a liquid applied to it.

20 Claims, 7 Drawing Sheets

LIQUID APPLICATION DEVICE

BACKGROUND OF THE INVENTION

1. Technical Field

This invention relates to a liquid application device for applying liquids or creams to the bottom of a user's foot without requiring the user to bend or to touch the liquid or cream.

2. Background Art

There are many different lotions, creams, ointments, medications and the like that people apply to the bottom of their feet. The reasons for these applications range from dry feet to foot fungus and typically require multiple applications to cure the ailment.

For many people, application of these lotions and/or creams can be a difficult even painful process. For example, older people with arthritis, diabetes or other crippling diseases may have difficulty bending over or lifting their feet into a position where they can reach the bottom of their foot to apply the lotion or cream. Pregnant women may have a problem reaching their feet or even seeing them. Disabled people may not be able to reach their feet and/or apply lotion or cream to the bottom of their feet.

In other situations, a person may need to apply a medication for a prolonged period of time or the medication may be one which a person may not want on their hands.

In all of these situations, a liquid application device which will apply a liquid, cream, ointment, medication or the like to the bottom of a person's foot without requiring the person to bend or touch the medication or the like is desired.

DISCLOSURE OF THE INVENTION

The liquid application device of this invention has several features, no single one of which is solely responsible for its desirable attributes. Without limiting the scope of this invention as expressed by the claims that follow, its more prominent features will now be discussed briefly. A liquid application device, for applying liquid to a user's foot, configured according to the present invention may comprise: a base, further comprising a top and a bottom surface; a well formed in the top surface of the base, wherein the well is shaped in the approximation of a foot print and wherein the well has a peripheral wall; a non-slip surface coupled to the bottom surface of the base; an applicator removably coupled to the well wherein the applicator is formed in the approximate shape of a foot print and wherein the applicator is formed from a porous material; and wherein the applicator will hold a liquid applied to it.

An alternate embodiment of a liquid application device, for applying liquid to a user's foot, configured according to the present invention may comprise: a base, further comprising a top and a bottom surface wherein the top surface and the bottom surface are on opposite faces of the base; a well formed in the top surface of the base, wherein the well is shaped in the approximation of a foot print and wherein the well has a peripheral wall comprising ridges; a non-slip texture, coupled to the top surface of the base, on both the right and left sides of the well; and an applicator removably coupled to the well wherein the applicator is formed in the approximate shape of a foot print and wherein the applicator is formed from a porous material.

A liquid application kit for applying a liquid to a user's foot configured according to the present invention may comprise: at least one base, comprising a top and a bottom surface wherein a well is formed in the top surface of the base, wherein the well is shaped in the approximation of a foot print and wherein the well has a peripheral wall and a non-slip surface is coupled to the bottom surface of the base; at least one preloaded applicator removably coupled to the base wherein the applicator is formed in the approximate shape of a foot print and further comprising a porous material to which a liquid has been applied; and at least one replacement preloaded applicator formed in the approximate shape of a foot print and further comprising a porous material to which a liquid has been applied.

The foregoing and other features and advantages of the invention will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE PREFERRED EMBODIMENTS

As discussed above, embodiments of the present invention relate to a liquid application device for applying a liquid to the bottom of a user's foot. The liquid application device of the present invention may comprise a base and an applicator to which a liquid may be applied.

Figure 1:
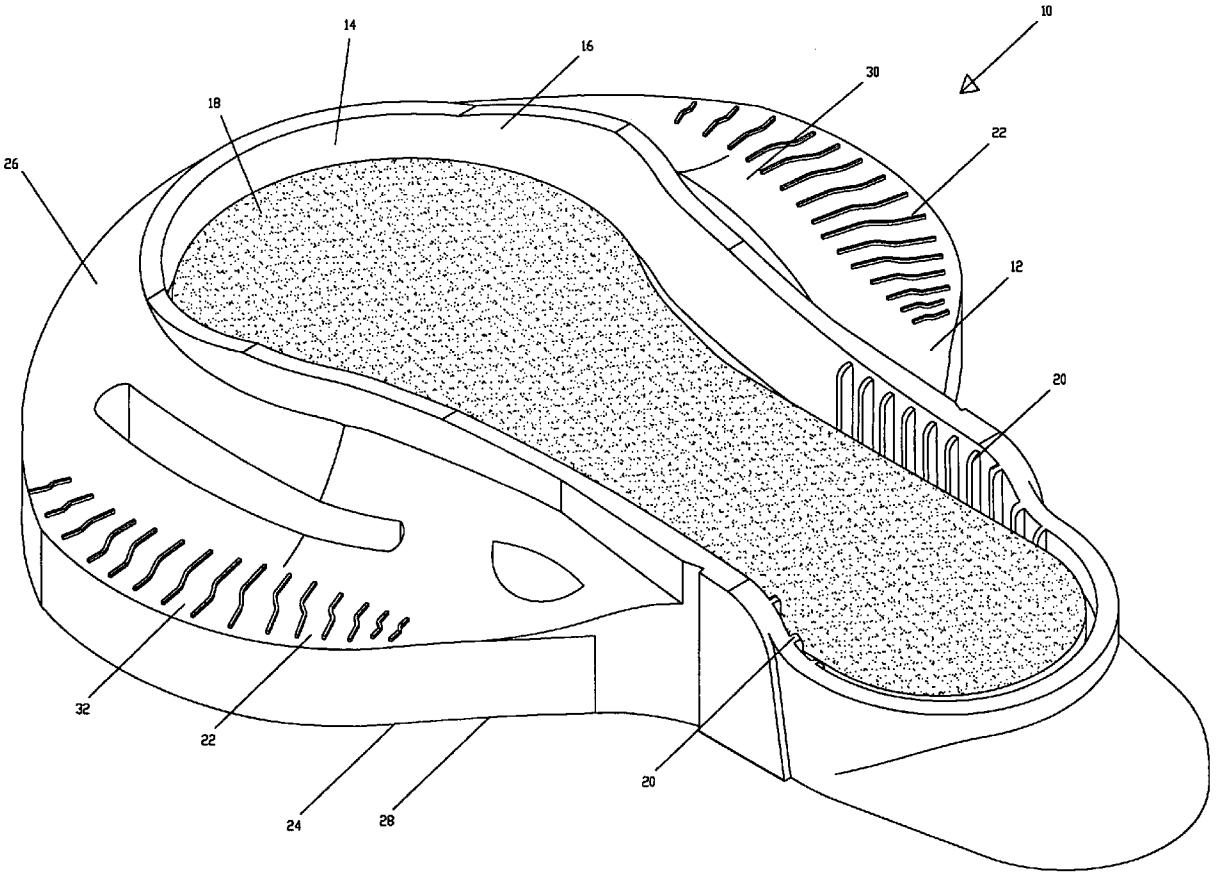
FIG. 1 is a perspective view of a liquid application device configured according to an embodiment of the present invention.
Figure 2:
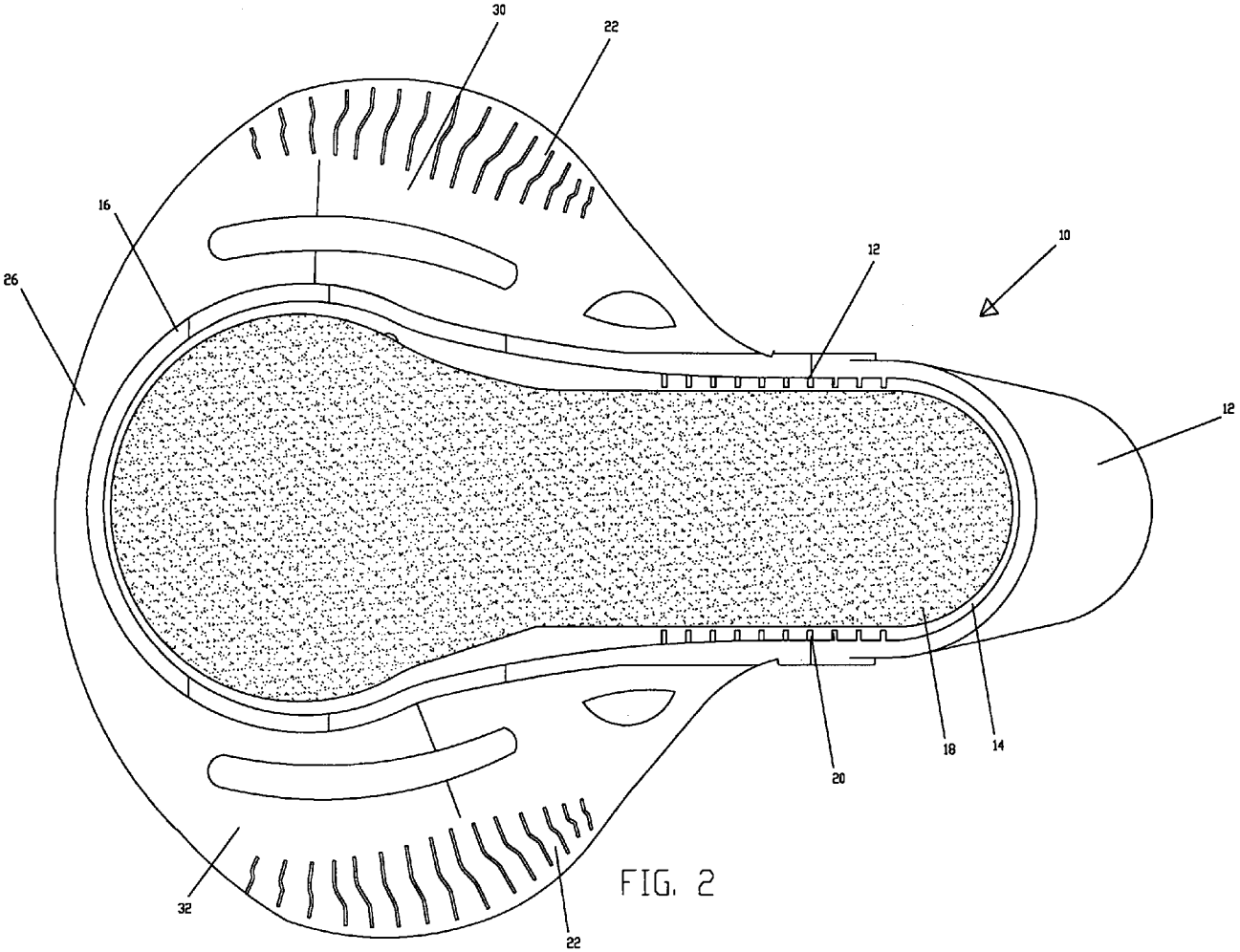
FIG. 2 is a top view of a liquid application device configured according to an embodiment of the present invention.
Figure 3:
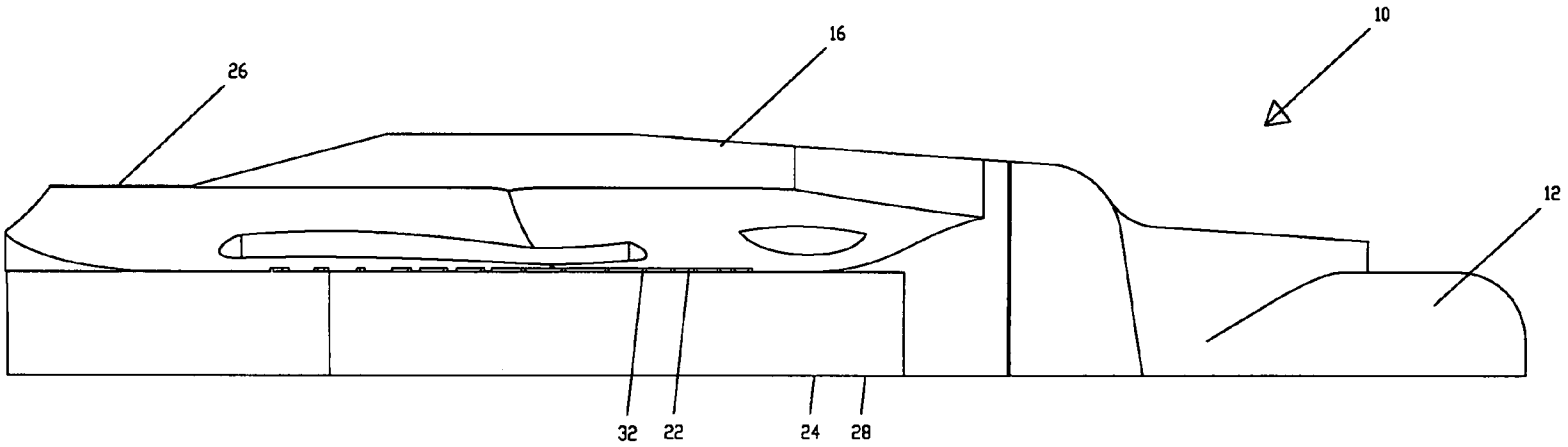
FIG. 3 is a side view of a liquid application device configured according to an embodiment of the present invention.
Figure 4:
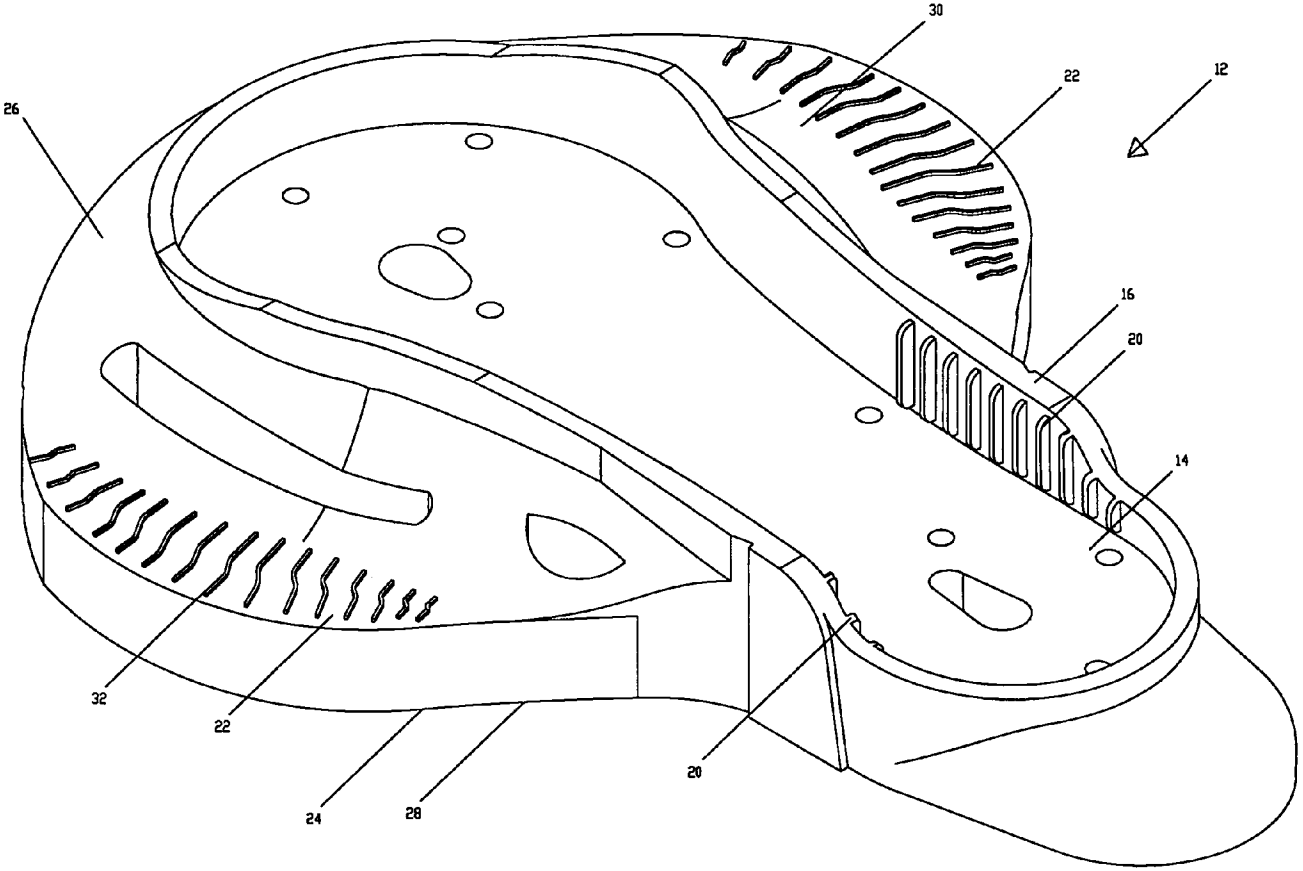
FIG. 4 is a perspective view of a base configured according to an embodiment of the present invention.

FIGS. 1-3 illustrate a liquid application device 10 configured according to an embodiment of the present invention comprising a base 12 and an applicator 18. The base 12 of the present invention, as illustrated in FIGS. 1-4, comprises a top surface 26 and a bottom surface 24. The top surface 26 is the surface that would be facing a user when the liquid application device 10 is in use. The bottom surface 24 is the surface of the base 12 that would be facing away from the user when the liquid application device 10 is in use. The bottom surface 24 and the top surface 26 of the base 12 are on directly opposite faces of the base 12.

A well 14 is coupled to the top surface 26 of the base 12. The well 14 may simply be formed in the top surface 26 of the base 12 or it may be formed separately and coupled to the top surface 26. The well 14 comprises a peripheral wall 16 that circumscribes the well 14. The well 14 may be formed in any shape desired, however it may be desirable to form the well 14 in the approximate shape of a foot print. This shape allows a user to place either their right or left foot in the liquid application device 10 in order to apply a liquid to the bottom of their foot. The shape also allows different sizes and shapes of feet to be placed in the well 14.

An applicator 18 is removably coupled to or placed in the well 14. The applicator 18 may be coupled with an adhesive or may simply be placed in the well 14. The applicator 18 may also be placed on a small post or some other device extending out of the bottom of the well 14 which would prevent the applicator 18 from moving in the well 14. In alternate embodiments, the peripheral wall 16 of the well 14 may also comprise ridges 20 which extend out of the peripheral wall 16 and may prevent both the applicator 18 and the user's foot from slipping in the well 14.

The applicator 18 should be formed in a shape similar to that of the well 14. In the embodiment portrayed in FIGS. 1-3 and 5-6, the applicator 18 is formed in a shape approximating a footprint. The applicator 18 may be formed from a porous material in order to allow a liquid such as a lotion, ointment, cream, medication or the like to be applied to the applicator 18 and held for application to a user's foot. The porous nature of the applicator 18 is illustrated by the shading in FIGS. 1-2 and 5. The applicator 18 may, however, be formed from any material that a liquid may be applied to and then transferred from the material to a user's foot.

Figure 5:
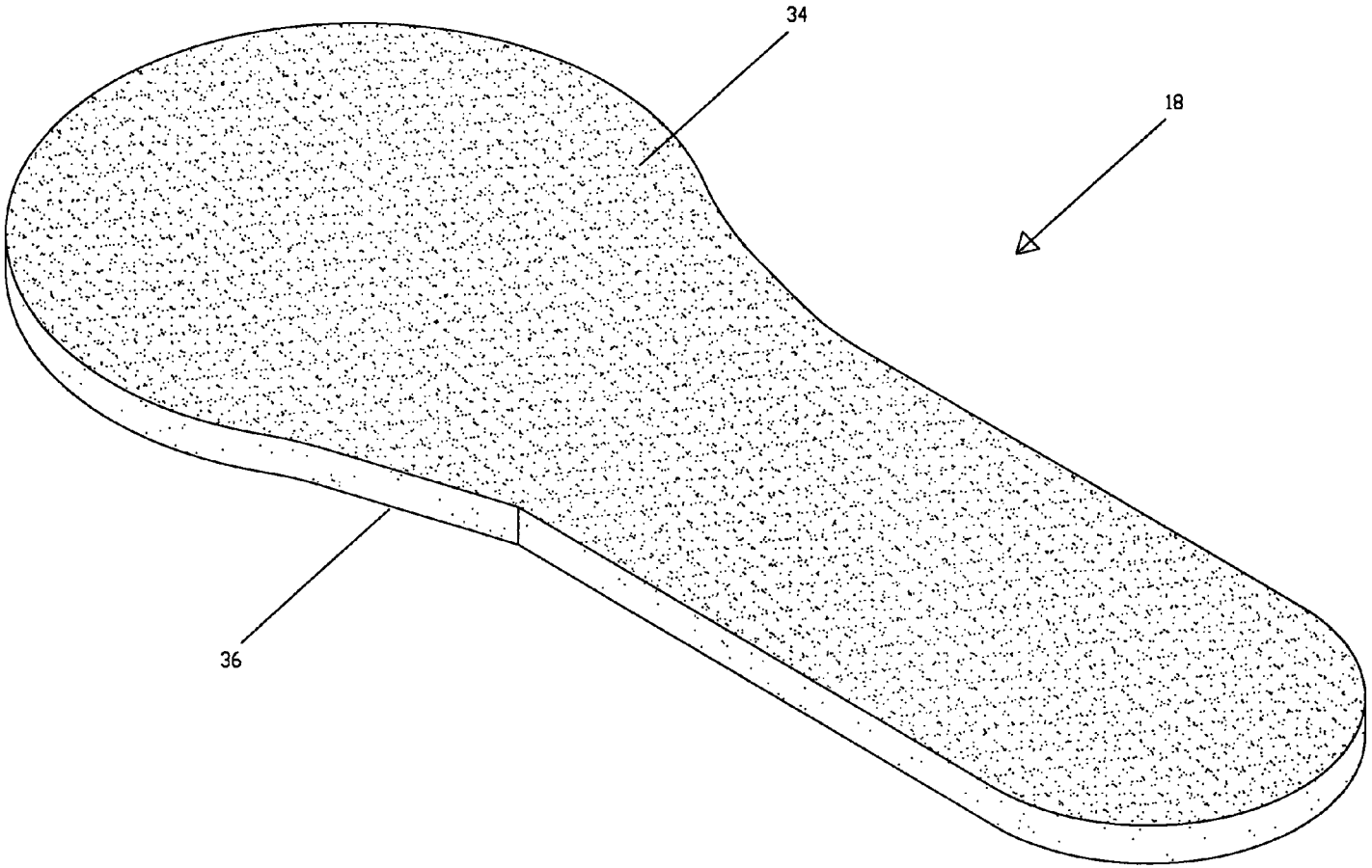
FIG. 5 is a perspective view of an applicator configured according to an embodiment of the present invention.
Figure 6:
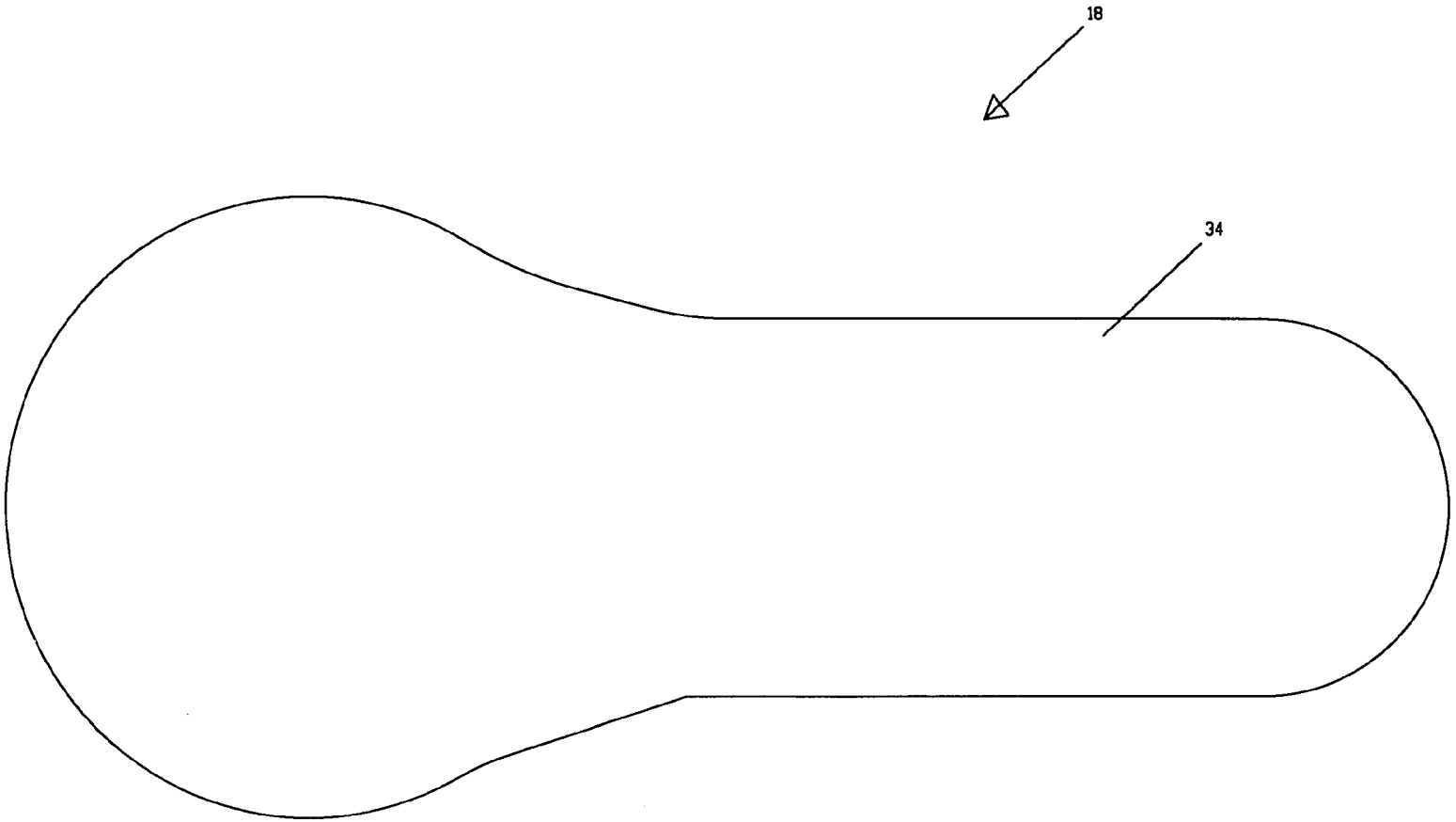
FIG. 6 is a top view of an applicator configured according to an embodiment of the present invention.
Figure 7:
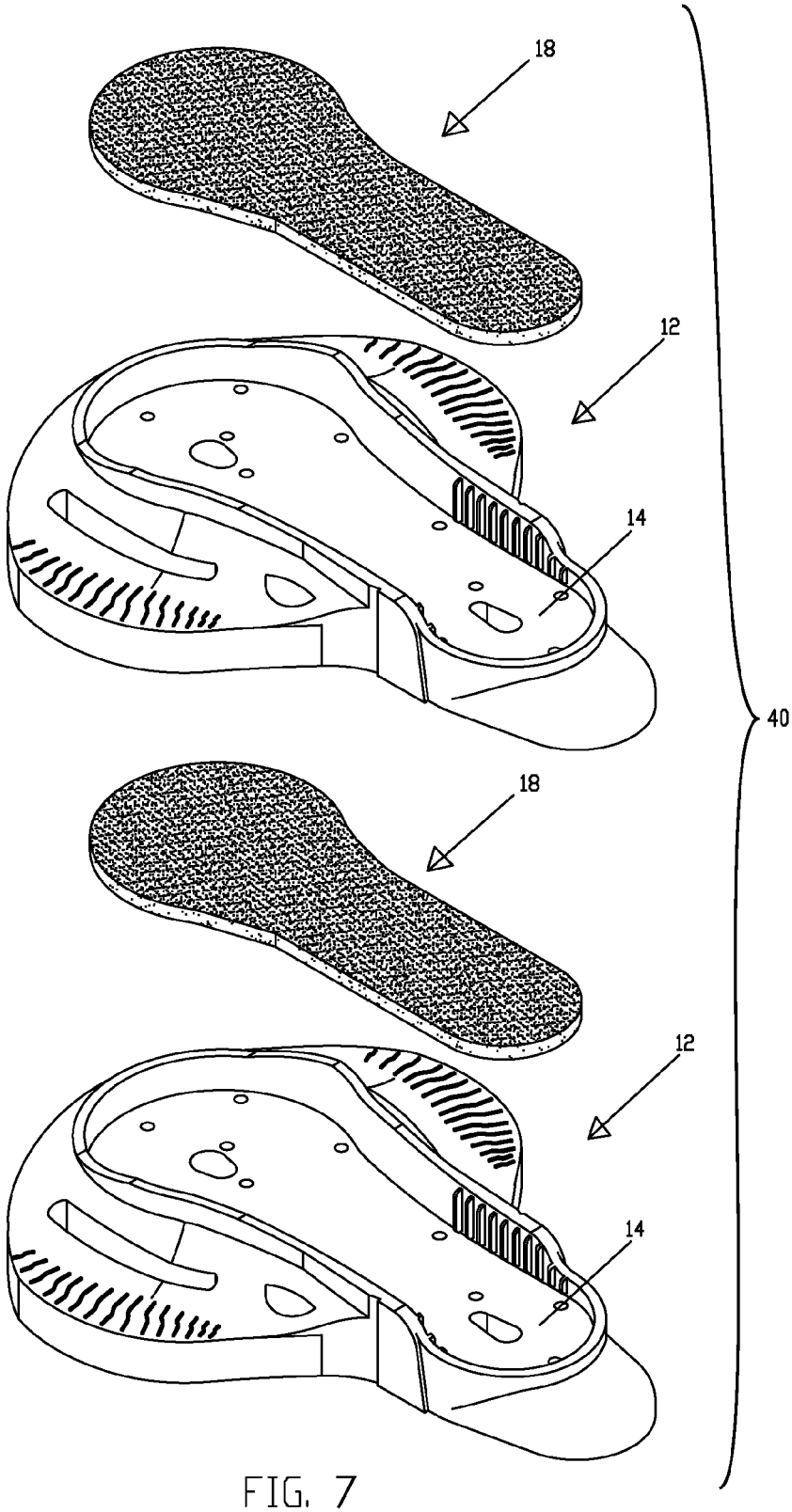
FIG. 7 is a perspective view of a liquid application kit.

As shown in FIGS. 5-6, the applicator 18 has a top 34 surface and a bottom 36 surface. A liquid may be applied to the top 34 surface of the applicator 18 and then a user places their foot on the top 34 surface of the applicator 18 and the liquid is transferred to the user's foot. The top 34 surface and the bottom 36 surface of the applicator may be identical, however in alternate embodiments of the present invention, the bottom 36 surface may be sealed in order to prevent the liquid from being forced or from leaking out the bottom 36 surface of the applicator 18. The sides of the applicator 18 may also be sealed.

In embodiments of the present invention, the applicator 18 may be preloaded with a liquid prior to the user purchasing the applicator 18. The applicator 18 may also be disposable. This allows a user to purchase several preloaded applicators 18 and dispose of them after they are used. A user may also reload a preloaded applicator 18 with any liquid desirable so that the applicator 18 may be re-used.

In using the present invention as illustrated in FIGS. 1-3, a user places a liquid on an applicator 18 or else they purchase a preloaded applicator 18. The user then places the applicator 18 in the well 14 of a base 12. The liquid may also be applied to the applicator 18 while it is in the well 14 of the base 12. Then the user places the liquid application device 10 on the floor. The user can then place one of their feet on the applicator 18 and the liquid is transferred from the applicator 18 to the user's foot. If the applicator 18 was preloaded, the user may remove the applicator 18 and throw it away. Then the user can place a new preloaded applicator 18 in the well 14 of the base 12. The user may also reload a preloaded applicator 18 and then replace it in the base 12. A user may wish to purchase multiple applicators 18 and rotate between them. Once an applicator 18 is worn out, it may be disposed of and a new applicator used.

In order to aid in the use of the liquid application device 10, the bottom surface 24 of the base 12 may comprise a non-slip surface 28 that would prevent the liquid application device 10 from moving around while it is in use.

In alternate embodiments, the base 12 may further comprise a non-slip texture 22 coupled to the top surface 26 of the base 12 on either the right 30 of the well 14 or the left 32 of the well 14. The non-slip texture 22 provides a location for the user's foot that is not in the liquid application device 10.

In other embodiments, the base 12 may further comprise a handle that allows the user to easily carry the liquid application device 10. The base 12 may also comprise a coupling device through which two or more bases 12 may be coupled together in order to allow the user to apply liquid to both of their feet at the same time.

Embodiments of the present invention may also comprise a heater which would warm the applicator 18 in order to provide a warm liquid for application to the user's feet.

The liquid application device 10 of the present invention may be placed in a kit for purchase by a user. A liquid application kit 40 configured according to an embodiment of the present invention may comprise at least one base 12 and at least one applicator 18. A kit 40 may also contain multiple applicators 18. For example, the kit 40 may contain a first applicator 18 and also a replacement applicator 18. After the first applicator 18 is used, the user may throw it away and place the replacement applicator 18 in the well 14 in the base 12. The applicators 18 may be preloaded or they may simply be empty in order to allow a user to load them.

The kit 40 may also contain multiple bases 12. The most common would be two bases 12 so that the user could apply liquid to both of their feet at once.

Kits 40 may be sold in which the applicators 18 are preloaded with many of the most popular liquids. For example, a kit 40 may be sold in which the applicators 18 are loaded with lotion. Another kit 40 may be sold in which the applicators 18 are preloaded with antifungal medication or the like.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The invention claimed is:

1. A liquid application device, for applying liquid to a user's foot, comprising:

a base, further comprising a top and a bottom surface;

a well formed in the top surface of the base, wherein the well is shaped in the approximation of a foot print and wherein the well has a peripheral wall;

a non-slip surface coupled to the bottom surface of the base; and an applicator removably coupled to the well wherein the applicator is formed in the approximate shape of a foot print and wherein the applicator is formed from a porous material;

wherein the applicator will hold a liquid applied to it, wherein said liquid is selected from the group consisting of lotions, ointments, creams, antifungals, medications, and/or mixtures thereof and the applicator further comprises a sealed bottom surface preventing the liquid from reaching the bottom of the well through the sealed bottom surface and sealed sides preventing the liquid from reaching the peripheral wall through the sealed sides, the liquid transferring to a user's foot only through a top surface of the applicator, and wherein the applicator directly engages skin on the user's foot.

2. The liquid application device of claim 1, wherein the applicator is disposable.

3. The liquid application device of claim 1, wherein the peripheral wall of the well further comprises ridges that prevent the applicator from sliding.

4. The liquid application device of claim 1, wherein the applicator is removed after use and replaced with a new applicator.

5. The liquid application device of claim 1, wherein the liquid application device applies liquid to either the user's right or left foot.

6. The liquid application device of claim 1, wherein the liquid application device is used on many different sized and/or shaped feet.

7. The liquid application device of claim 1 further comprising a heater, wherein the heater warms the applicator.

8. A liquid application device, for applying liquid to a user's foot, comprising:

a base, further comprising a top and a bottom surface wherein the top surface and the bottom surface are on opposite faces of the base;

a well formed in the top surface of the base, wherein the well is shaped in the approximation of a foot print and wherein the well has a peripheral wall comprising ridges;

a non-slip texture, coupled to the top surface of the base, on both the right and left sides of the well;

an applicator removably coupled to the well with an adhesive wherein the applicator is formed in the approximate shape of a foot print and wherein the applicator is formed from a porous material, wherein the applicator directly engages skin on the user's foot, and wherein the applicator will hold a liquid applied to it, wherein said liquid is selected from the group consisting of lotions, ointments, creams, antifungals, medications, and/or mixtures thereof; and a heater, wherein the heater warms the applicator.

9. The liquid application device of claim 8, wherein the applicator holds a liquid applied to it.

10. The liquid application device of claim 8, wherein the applicator is disposable.

11. The liquid application device of claim 8, wherein the applicator is removed after use and replaced with a new applicator.

12. The liquid application device of claim 8, wherein the liquid application device applies liquid to either the user's right or left foot.

13. The liquid application device of claim 8, wherein the liquid application device is used on many different sized and/or shaped feet.

14. The liquid application device of claim 8, wherein the applicator will hold a liquid applied to it and wherein the applicator further comprises:

a sealed bottom surface preventing the liquid from reaching the bottom of the well through the sealed bottom surface; and sealed sides preventing the liquid from reaching the peripheral wall through the sealed sides.

15. A liquid application kit for applying a liquid to a user's foot comprising:

at least one base, comprising a top and a bottom surface wherein a well is formed in the top surface of the base, wherein the well is shaped in the approximation of a foot print and wherein the well has a peripheral wall and a non-slip surface is coupled to the bottom surface of the base;

at least one preloaded applicator removably coupled to the base by use of an adhesive wherein the applicator is formed in the approximate shape of a foot print and further comprising a porous material to which a liquid has been applied; and at least one replacement preloaded applicator formed in the approximate shape of a foot print and further comprising a porous material to which a liquid has been applied, wherein the at least one applicator further comprises a sealed bottom surface preventing the liquid from reaching the bottom of the well through the sealed bottom surface and sealed sides preventing the liquid from reaching the peripheral wall through the sealed sides, the liquid transferring to a user's foot only through a top surface of the applicator, wherein the applicator directly engages skin on the user's foot, and wherein said liquid is selected from the group consisting of lotions, ointments, creams, antifungals, medications, and/or mixtures thereof.

16. The liquid application kit of claim 15, comprising two bases and two preloaded applicators.

17. The liquid application kit of claim 15, wherein the at least one preloaded applicator and the at least one replacement preloaded applicator are disposable.

18. The liquid application kit of claim 15, wherein the at least one preloaded applicator is reloaded with liquid.

19. The liquid application kit of claim 15, wherein the liquid application kit is used on many different sized and/or shaped feet.

20. The liquid application kit of claim 15, wherein the at least one preloaded applicator and the at least one replacement preloaded applicator is loaded with any liquid desired by a user.

* * * * *